US008938326B1

(12) United States Patent
Fanara

(10) Patent No.: US 8,938,326 B1
(45) Date of Patent: Jan. 20, 2015

(54) SYSTEM AND METHOD FOR EXPEDITING DATA TRANSFER FOR A LOCOMOTIVE

(71) Applicant: Electro-Motive Diesel, Inc., La Grange, IL (US)

(72) Inventor: Mark Alan Fanara, Blue Springs, MO (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 0 days.

(21) Appl. No.: 14/061,975

(22) Filed: Oct. 24, 2013

(51) Int. Cl.
*G05D 1/00* (2006.01)
*B61L 15/00* (2006.01)

(52) U.S. Cl.
CPC ..... *B61L 15/0018* (2013.01)
USPC ..... 701/19

(58) Field of Classification Search
USPC ..... 701/19
See application file for complete search history.

(56) References Cited

U.S. PATENT DOCUMENTS

| | | | | |
|---|---|---|---|---|
| 6,314,466 | B1 * | 11/2001 | Agarwal et al. | 709/231 |
| 6,339,785 | B1 * | 1/2002 | Feigenbaum | 709/213 |
| 7,618,011 | B2 | 11/2009 | Oleski et al. | |
| 7,817,019 | B2 | 10/2010 | Lesesky | |
| 8,398,405 | B2 | 3/2013 | Kumar | |
| 8,655,515 | B2 * | 2/2014 | Noffsinger et al. | 701/19 |
| 2009/0219900 | A1 | 9/2009 | Kokkinen et al. | |
| 2010/0029209 | A1 | 2/2010 | Daum et al. | |
| 2010/0070116 | A1 * | 3/2010 | Kumar et al. | 701/19 |
| 2010/0131127 | A1 * | 5/2010 | DeSanzo | 701/19 |
| 2010/0168942 | A1 * | 7/2010 | Noffsinger et al. | 701/21 |
| 2010/0174484 | A1 * | 7/2010 | Sivasubramaniam et al. | 701/213 |
| 2010/0241295 | A1 | 9/2010 | Cooper et al. | |
| 2011/0186692 | A1 * | 8/2011 | Kumar et al. | 246/29 R |
| 2012/0078454 | A1 * | 3/2012 | Kumar | 701/19 |
| 2012/0136514 | A1 | 5/2012 | Noffsinger et al. | |
| 2012/0264370 | A1 | 10/2012 | Smith, Jr. et al. | |
| 2012/0287972 | A1 | 11/2012 | Noffsinger et al. | |
| 2012/0290157 | A1 * | 11/2012 | Siddappa et al. | 701/20 |

* cited by examiner

*Primary Examiner* — Huessein A. Elchanti
(74) *Attorney, Agent, or Firm* — Finnegan, Henderson, Farabow, Garrett & Dunner LLP

(57) ABSTRACT

A system is provided to expedite the transfer of data between an offboard server and a a locomotive in a consist. A wireless device may be located on each of a plurality of locomotives in the consist. A router may be located on each of the locomotives in the consist, with each router being communicatively coupled to an associated wireless device. A client processor may be located onboard each of the locomotives in the consist, with each client processor being configured to divide data to be transferred between the offboard server and the client processor into a plurality of subsets of data packets, and request transfer of each of the plurality of subsets of data packets in parallel between the offboard server and a different one of the routers on a different one of the plurality of locomotives.

20 Claims, 3 Drawing Sheets

SYSTEM AND METHOD FOR EXPEDITING DATA TRANSFER FOR A LOCOMOTIVE

TECHNICAL FIELD

The present disclosure relates generally to a system and method for transferring data, and more particularly, a system and method for expediting data transfer for a locomotive.

BACKGROUND

A consist includes one or more locomotives that are coupled together to produce motive power for a train of rail vehicles. The locomotives each include one or more engines, which combust fuel to produce mechanical power. The engine(s) of each locomotive can be supplied with liquid fuel (e.g., diesel fuel) from an onboard tank, gaseous fuel (e.g., natural gas) from a tender car, or a blend of the liquid and gaseous fuels. The mechanical power produced by the combustion process is directed through a generator and used to generate electricity. The electricity is then routed to traction motors of the locomotives, thereby generating torque that propels the train. The locomotives can be connected together at the front of the train or separated and located at different positions along the train. For example, the consist can be positioned at the front, middle, or end of the train. In some instances, more than one consist can be included within a single train. The locomotives in a consist can be oriented in a forward-facing (or "long hood") direction or a backward-facing (or "short hood") direction. In some consists, the locomotives include computer systems for maintaining operations of the locomotive. These computer systems are sometimes disposed on the long hood side of the locomotive.

Because the locomotives of a consist must cooperate to propel the train, communication between the locomotives, and the upload and download of data to and from offboard servers can be important. Historically, this communication has been facilitated through the use of an MU (Multi-Unit) cable that extends along the length of the consist, and various forms of wireless communication with offboard controllers. An MU cable may include many different wires, each capable of carrying a discrete signal used to regulate a different aspect of consist operation. For example, a lead locomotive generates current within a particular one of the wires to indicate a power level setting requested by the train operator. When this wire is energized, the engines of all trail locomotives are caused to operate at a specific throttle value. In another example, when one locomotive experiences a fault condition, another of the wires is energized to alert the other locomotives of the condition's existence.

Although acceptable in some applications, the information traditionally transmitted between locomotives via the MU cable, or offboard the consist via wireless communications, may be insufficient in other applications. Additionally, the transfer of large data files or other communications between locomotives in the consist and offboard servers may take unacceptably long periods of time. For example, during the fault condition described above, or at other times when the movements of the locomotives are being monitored and controlled using positive train control (PTC), it can be important to transfer large amounts of data rapidly. As consist configurations become more complex, control of the locomotives may require the rapid transfer of large amounts of data both between the locomotives in a consist and between onboard controllers and offboard servers.

One attempt to address the above-described problems is disclosed in U.S. Patent Publication 2010/0241295 of Cooper et al. that published on Sep. 23, 2010 ("the '295 publication"). Specifically, the '295 publication discloses a consist having a lead locomotive and one or more trailing locomotives connected to each other via an MU cable. Each locomotive includes a computer unit, which, along with the MU cable, forms an Ethernet network in the train. With this configuration, network data can be transmitted from the computer unit in the lead locomotive to the computer units in the trailing locomotives. The network data includes data that is packaged in packet form as data packets and uniquely addressed to particular computer units. The network data can be vehicle sensor data indicative of vehicle health, commodity condition data, temperature data, weight data, and security data. The network data is transmitted orthogonal to conventional non-network (i.e., command) data that is already being transmitted on the MU cable.

While the consist of the '295 publication may have improved communication between locomotives, it may still be less than optimal. In particular, multiple packets of network data cannot be transmitted in parallel, and as a result optimal performance is not realized. Additionally, the '295 publication does not provide a way to expedite the transfer of large amounts of data between the locomotives and an offboard server. The system of the present disclosure solves one or more of the problems set forth above and/or other problems with existing technologies.

SUMMARY

In one aspect, the present disclosure is directed to a system for expediting the transfer of data between an offboard server and a locomotive in a consist. The system may include a wireless device located on each of a plurality of locomotives in the consist. A router may also be located on each of the locomotives in the consist, each router being communicatively coupled to an associated wireless device. A client processor may be located onboard each of the locomotives in the consist. The client processor may be configured to divide data to be transferred between the offboard server and the client processor into a plurality of subsets of data packets, and request transfer of each of the plurality of subsets of data packets along one of parallel communication pathways between the offboard server and the routers on different ones of the plurality of locomotives.

In another aspect, the present disclosure is directed to a method of expediting the transfer of data between an offboard server and a client processor onboard a locomotive in a consist. The method may include sending a route request from the client processor to an associated router on the locomotive. The route request may include a request to establish multiple parallel communication pathways between the client processor and the offboard server. The method may further include establishing communication between the associated router and one or more additional routers on other locomotives of the consist to establish the multiple parallel communication pathways. The method may include determining the amount of data to be transferred between the client processor and the offboard server, and determining how to divide up the data for transfer over the multiple parallel communication pathways. The method may also include initiating simultaneous transfer of portions of the data over each of the multiple parallel communication pathways.

In still another aspect the present disclosure is directed to a consist of locomotives including a plurality of locomotives, with each of the locomotives including a control computer with a client processor configured to transfer data between an offboard server and the client processor. Each of the locomotives may also include a wireless device, and a router communicatively coupled to the wireless device. The client processor may be configured to divide data to be transferred between the offboard server and the client processor into a plurality of subsets of data packets, and request transfer of each of the plurality of subsets of data packets in parallel between the offboard server and a different one of the routers on a different one of the plurality of locomotives.

DETAILED DESCRIPTION

Figure 1:
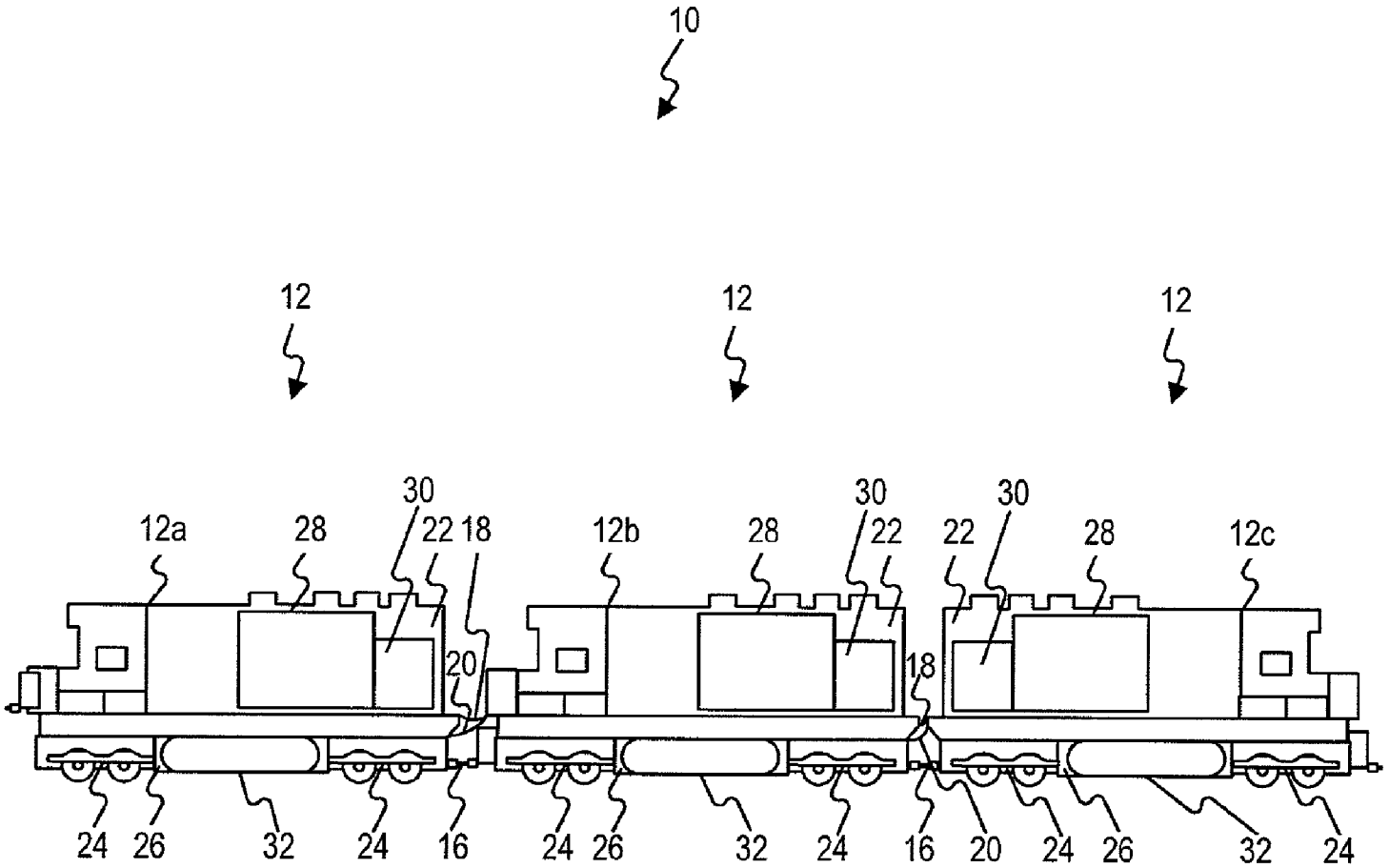
FIG. 1 is a pictorial illustration of an exemplary disclosed locomotive consist.

FIG. 1 illustrates an exemplary train consist 10 having one or more locomotives 12. In the disclosed embodiment, consist 10 has three different locomotives 12, including a lead locomotive 12*a* and two trailing locomotives 12*b*, 12*c*. Consist 10 can include any number of locomotives 12 and other cars (e.g. tender cars), and locomotives 12 can be located in any arrangement and in any orientation (e.g., forward-facing or rear-facing). Consist 10 can be located at the front of a train of other rail vehicles (not shown), within the train of rail vehicles, or at the end of the train of rail vehicles. More than one consist 10 can be included within a single train of rail vehicles, if desired, and/or consist 10 may travel at times without a train of other rail vehicles.

Each locomotive 12 can be connected to an adjacent locomotive 12 in several different ways. For example, locomotives 12 can be connected to each other via a mechanical coupling 16, one or more fluid couplings 18, and one or more electrical couplings 20. Mechanical coupling 16 can be configured to transmit tractive and braking forces between locomotives 12. Fluid couplings 18 can be configured to transmit fluids (e.g., fuel, coolant, lubrication, pressurized air, etc.) between locomotives 12. Electrical couplings 20 can be configured to transmit power and/or data (e.g., data in the form of electrical signals) between locomotives 12. In one example, electrical couplings 20 include an intra-consist electrical cable 80 (shown in FIG. 2), such as a MU cable, configured to transmit conventional command signals and/or electrical power. In another example, electrical couplings 20 include a dedicated data link configured to transmit packets of data (e.g., Ethernet data). In yet another example, the data packets can be transmitted via the intra-consist electrical cable 80. Some data may be transmitted between locomotives 12 via a combination of the intra-consist electrical cable, the dedicated data link, and/or other means (e.g., wirelessly), if desired.

Each locomotive 12 can include a car body 22 supported at opposing ends by a plurality of trucks 24 (e.g., two trucks 24). Each truck 24 can be configured to engage a track (not shown) via a plurality of wheels, and to support a frame 26 of car body 22. Any number of engines 28 can be mounted to frame 26 within car body 22 and drivingly connected to a generator 30 to produce electricity that drives traction motors for propelling the wheels of each truck 24. Engines 28 can be internal combustion engines configured to combust a mixture of air and fuel. The fuel can include a liquid fuel (e.g., diesel) provided to engines 28 from a tank 32 located onboard each locomotive 12 or via fluid couplings 18, and/or a blended mixture of the liquid and gaseous fuels.

Figure 2:
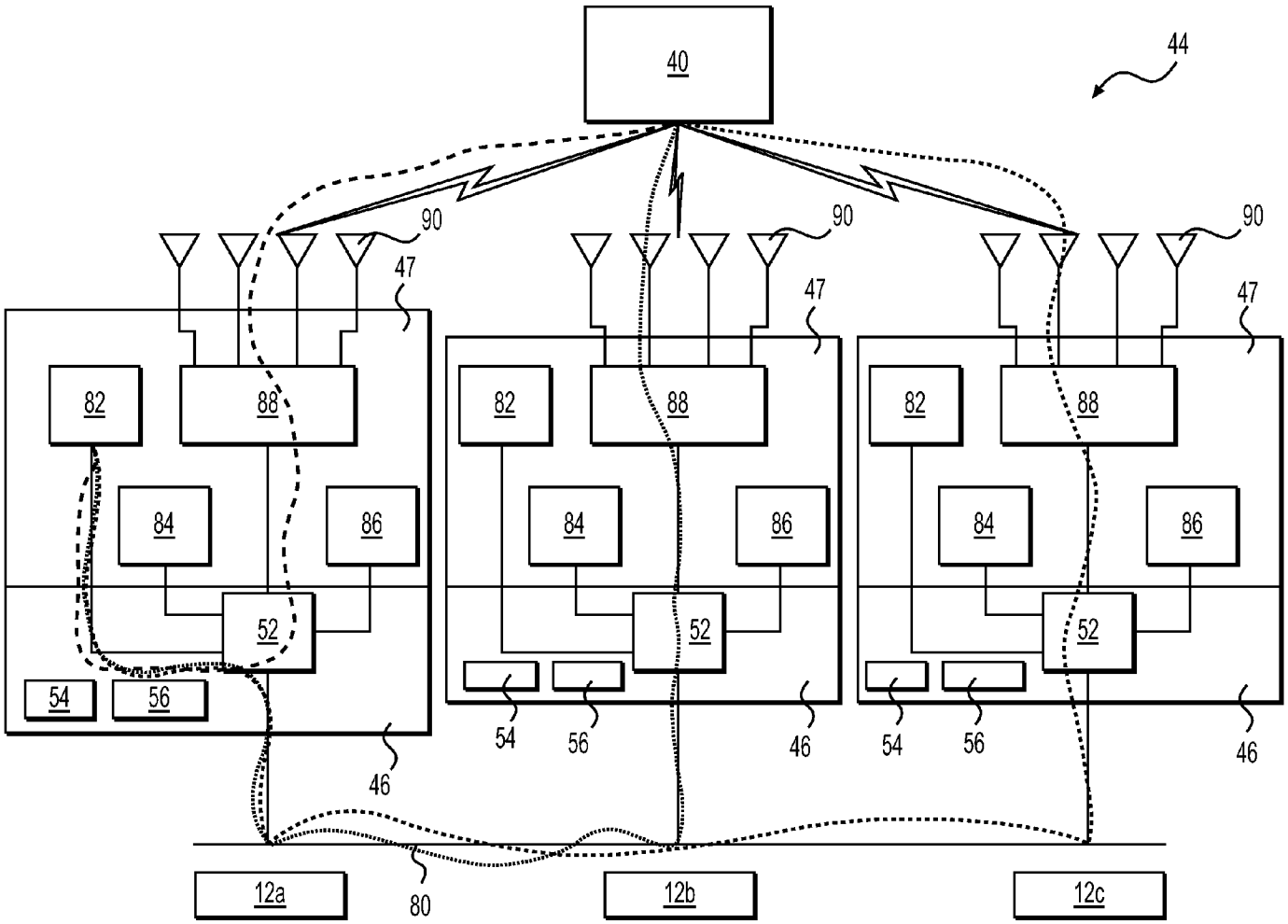
FIG. 2 is a diagrammatic illustration of an exemplary disclosed communication system that may be used in conjunction with the consist of FIG. 1.

As shown in FIG. 2, consist 10 can be equipped with a communication system 44 that facilitates coordinated control of locomotives 12. Communication system 44 encompasses communication between the locomotives in the consist and between the locomotives and an offboard server. Communication system 44 can include, among other things, an access point 46 for each locomotive 12. Each access point 46 can be connected to one or more wired and/or wireless networks, and used to communicate command signals and/or data between communication management units 88 of each rail vehicle, locomotive control computers 82, engine control computers 84, and various other network components 86 (e.g., sensor, valves, pumps, heat exchangers, accumulators, regulators, actuators, GPS components, etc.) that are used to control locomotives 12. One or more of the control computers 82, 84 on one or more of the locomotives in consist 10 can include a client processor with an associated transfer protocol client for establishing network communications between the locomotives and with an offboard server 40. The specific locomotive Internet Protocol (IP) networking architecture used on each of the locomotives in the consist can vary, and the various disclosed implementations are not dependent on any one particular IP networking architecture. Data may be transferred between the offboard server and the client processor using a data transfer protocol selected from one of Hypertext Transfer Protocol (HTTP), File Transfer Protocol (FTP), Secure Copy Protocol (SCP), or other known or future-developed standard or proprietary data transfer protocols. Relevant standards established by the Association of American Railroads (AAR) may govern locomotive electronics and train consist system architecture, and in particular intra-consist communications (ICC) routing functionality, such as described in document M-9154A. Access points 46 can be connected to each other via electrical couplings 20 (e.g., via the intra-consist electrical cable 80, via the dedicated data link, and/or wirelessly). Access points 46 can also be connected by local area networks (LAN) 47 to control computers 82, 84, network components 86, and communication management units 88. Communication management units 88 can provide a default gateway for an associated data directing device, such as a router on each of the locomotives. In various alternative implementations, a communication management unit 88 can be any wireless device that establishes a wireless interface between an inter-consist router ("IC router") 52 and a wireless connection 90 to an offboard server 40. In various disclosed implementations, the default gateways can be connected over wireless connections 90 (Wi-Fi, Cellular, Satellite, Data Radio) to offboard server 40, which may be located at a central dispatch center, a wayside station, or other locations offboard the locomotives in the consist.

Each access point 46 can include an inter-consist router ("IC router") 52, an Ethernet bridge 54, and an MU modem 56, as well as conventional computing components known in the art (not shown) such as a processor, input/output (I/O) ports, a storage, a memory. The I/O ports may facilitate communication between associated access points 46 and communication management units 88. In some embodiments, the I/O ports may facilitate communication between the associated access points 46 and one or more of network components 86.

Likewise, IC routers 52 can facilitate communication between different access points 46 of locomotives 12 that are connected to each other via electrical couplings 20. In some embodiments, the IC routers 52 on each locomotive may communicate with each other and establish a set of network address translation (NAT) rules that determine the overall direction of network data traffic throughout the consist. Each IC router 52 can provide a proxy IP address to a router on another locomotive in the consist. The receiving router can then communicate over LAN 47 with a client processor on the locomotive and provide the client processor with the proxy IP addresses corresponding to all of the routers on other locomotives in the consist. The client processor can use these proxy IP addresses to establish multiple communication pathways for transferring data between the client processor on a locomotive and the offboard server 40. The client processor configured for initiating transfer of data between the various locomotives and the offboard server may be a part of one or more of control computers 82, 84 on any one of the locomotives 12*a*, 12*b*, 12*c* in consist 10. Each IC router 52 on each locomotive can also communicate over LAN 47 with a communication management unit 88 that acts as a default gateway to wireless communications with offboard server 40. Each IC router 52 may also include, or be connected to, an Ethernet bridge 54 that can be configured to translate network data to an electrical signal capable of being sent through intra-consist electrical cable 80. Ethernet bridge 54 can include or be connected to MU modem 56. MU modem 56 can be configured to modulate a carrier signal sent over intra-consist electrical cable 80 with the electrical signal received from Ethernet bridge 54 to transmit network data between access points 46. MU modem 56 can also be configured to demodulate signals received from access points 46 and send the demodulated signals to Ethernet bridge 54 for conversion to network data destined to control computers 82, 84 or network components 86. In some embodiments, MU modem 56 sends network data orthogonal to data traditionally transmitted over intra-consist electrical cable 80 (e.g., control data). Although FIG. 2 illustrates IC router 52, Ethernet bridge 54, and MU modem 56 as separate components, in some embodiments, one component can perform the functionality of two components. For example, Ethernet bridge 54 may perform the operations described above with respect to IC router 52, or Ethernet bridge 54 can include, or perform the operations of, MU modem 56.

In some embodiments, access point 46, IC router 52, Ethernet bridge 54, and/or MU modem 56 can include a processor, storage, and/or memory (not shown). The processor can include one or more processing devices, such as microprocessors and/or embedded controllers. The storage can include volatile or non-volatile, magnetic, semiconductor, tape, optical, removable, non-removable, or other type of computer-readable medium or computer-readable storage device. The storage can be configured to store programs and/or other information that can be used to implement one or more of the processes discussed below. The memory can include one or more storage devices configured to store information.

Each control computer 82, 84 can be configured to control operational aspects of its related rail vehicle. For example, locomotive control computer 82 and engine control computer 84 of lead locomotive 12*a* can be configured to control operational aspects of corresponding engine 28, generator 30, traction motors, operator displays, and other associated components. Likewise, the control computers 82, 84 of trail locomotives 12*b* and 12*c* can be configured to control operational aspects of their corresponding engines 28, generators 30, traction motors, operator displays, and other associated components. In some embodiments, control computers 82, 84 of lead locomotive 12*a* can be further configured to control operational aspects of trailing locomotives 12*b* and 12*c*, if desired. For example, control computers 82, 84 of lead locomotive 12*a* can send commands through access point 46 to the access points 46 of trailing locomotives 12*b* and 12*c*.

Each control computer 82, 84 can embody a single microprocessor or multiple microprocessors that include a means for controlling an operation of the associated rail vehicle based on information obtained from any number of network components 86 and/or communications received via access points 46. One or more of control computers 82, 84 can also include client processors configured for transferring data and files between the locomotives and offboard server 40. Numerous commercially available microprocessors can be configured to perform the functions of the control computers. The control computers can include a memory, a secondary storage device, a processor, and any other components for running an application. Various other circuits may be associated with the control computers such as power supply circuitry, signal conditioning circuitry, solenoid driver circuitry, and other types of circuitry.

The information obtained by a particular control computer 82, 84 via access points 46 and/or network components 86 can include performance related data associated with operations of each locomotive 12 ("operational information"). For example, the operational information can include engine related parameters (e.g., speeds, temperatures, pressures, flow rates, etc.), generator related parameters (e.g., speeds, temperatures, voltages, currents, etc.), operator related parameters (e.g., desired speeds, desired fuel settings, locations, destinations, braking, etc.), liquid fuel related parameters (e.g., temperatures, consumption rates, fuel levels, demand, etc.), gaseous fuel related parameters (e.g., temperatures, supply rates, fuel levels, etc.), and other parameters known in the art.

The information obtained by a particular control computer 82, 84 via access points 46 and/or network components 86 can also include identification data of the other rail vehicles within the same consist 10. For example, each control computer can include stored in its memory the identification of the particular rail vehicle with which the control computer is associated. The identification data can include, among other things, a type of rail vehicle (e.g., make, model, and unique identification number), physical attributes of the associated rail vehicle (e.g., size, load limit, volume, power output, power requirements, fuel consumption capacity, fuel supply capacity, etc.), and maintenance information (e.g., maintenance history, time until next scheduled maintenance, usage history, etc.). When coupled with other rail vehicles within a particular consist 10, each control computer 82, 84 can be configured to communicate the identification data to the other control computers within the same consist 10. Each control computer can be configured to selectively affect operation of its own rail vehicle based on the obtained identification data associated with the other rail vehicles of consist 10.

In some embodiments, control computers 82, 84 can be configured to affect operation of their associated rail vehicles based on the information obtained via access points 46 and/or network components 86 and one or more maps stored in memory. Each of these maps may include a collection of data in the form of tables, graphs, and/or equations. Control computers 82, 84 can be configured to affect operation of their associated locomotives based on the position within a locomotive consist. The position of the locomotive associated with each control computer can be used with the one or more maps to control the operation of the locomotive. For example, a map of throttle settings can be stored in the memory of a locomotive control computer 82. The map of throttle settings can include a mapping of consist position to throttle setting.

As illustrated by the three sets of dashed lines in FIG. 2, a client processor of a locomotive control computer 82 in a first locomotive 12*a* may be configured to selectively establish three separate, parallel lines of communication with offboard server 40. The ability to establish these separate, parallel lines of communication may enable the client processor to achieve a faster transfer of data between the client processor and offboard server 40. In one exemplary implementation, the client processor on locomotive 12*a* may be configured to request that associated IC router 52 on locomotive 12*a* communicate with IC routers 52 on locomotive 12*b* and locomotive 12*c*. Alternative implementations may include a client processor on any one of the locomotives establishing plural, parallel lines of communication with one or more other locomotives in the consist. IC routers 52 on the different locomotives may be configured to communicate between themselves and establish sets of network address translation (NAT) rules that establish the overall direction of traffic for communication between the client processor on locomotive 12*a* and offboard server 40.

In one exemplary implementation, communication between IC routers 52 on locomotives 12*a* and 12*b* may result in IC router 52 on locomotive 12*a* providing a proxy IP address to the client processor on locomotive 12*a* that the client processor will use in order to send traffic to offboard server 40 via the IC router 52 and communication management unit 88 on locomotive 12*b*. Similarly, communication between IC routers 52 on locomotives 12*a* and 12*c* may result in IC router 52 on locomotive 12*a* providing a proxy IP address to the client processor on locomotive 12*a* that the client processor will use in order to send traffic to offboard server 40 via the IC router 52 and communication management unit 88 on locomotive 12*c*. Any data traffic received from offboard server 40 by the respective communication management units 88 on each locomotive may be forwarded to the associated IC router on each locomotive, and along the established parallel communication pathways to the IC router and client processor on locomotive 12*a*.

A client processor on any one of the locomotives may be configured to establish multiple, parallel communication pathways as described above. The client processor may be configured to request that the IC routers on multiple locomotives at different positions in a consist communicate amongst themselves in order to establish NAT rules that will expedite the transfer of data between the client processor and the offboard server. The client processor may also be configured to determine an optimum number of simultaneous downloads or uploads of data between the client processor and the offboard server as well as the optimum relative size of each file portion. In various exemplary implementations, the client processor may be configured to determine the relative speeds of the various wireless connections 90 between each communication management unit 88 on each locomotive and offboard server 40. Based on these determinations, the client processor may be configured to request the transfer of different amounts of data over different ones of the parallel communication pathways.

Figure 3:
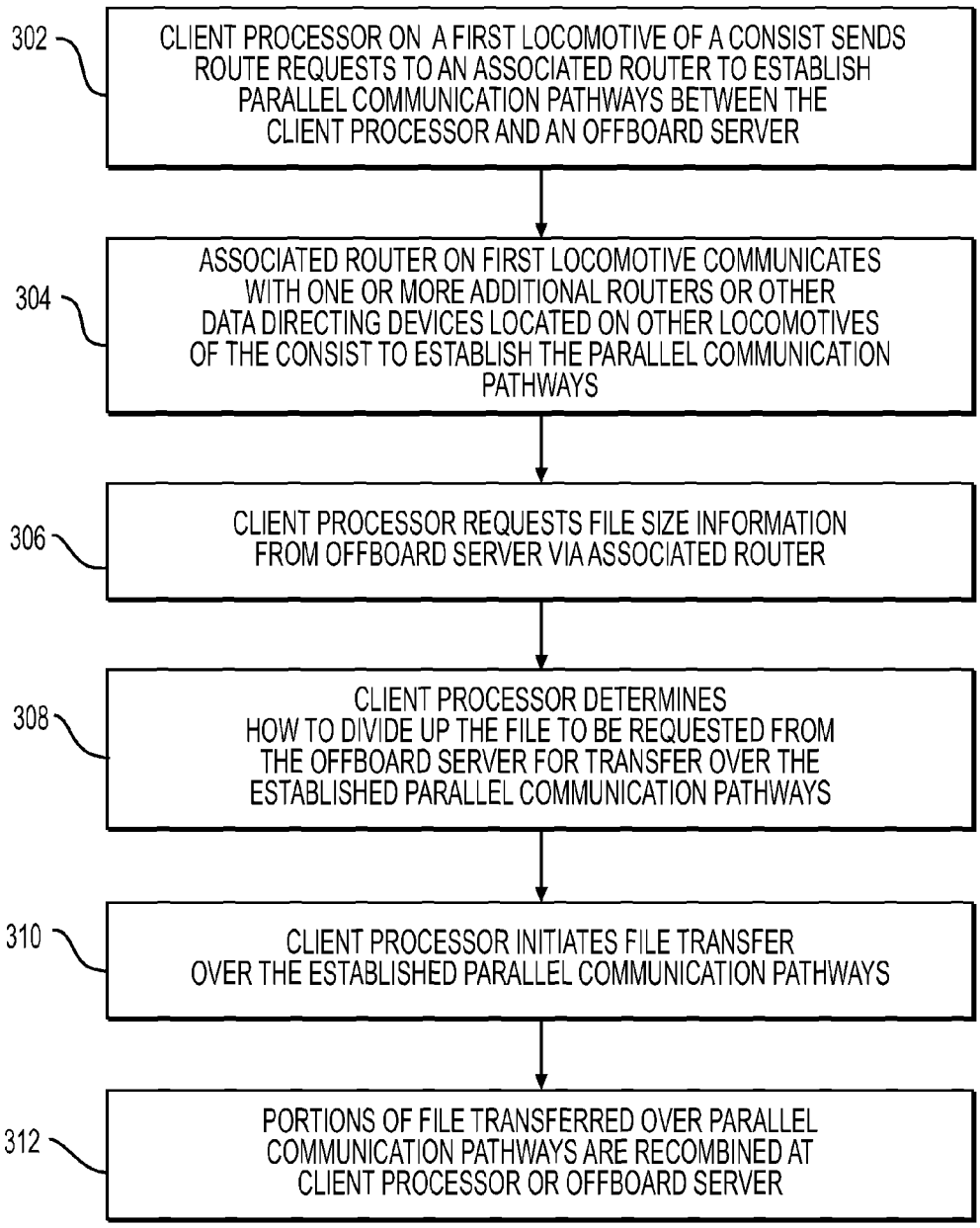
FIG. 3 is a flowchart illustrating an exemplary disclosed method for expediting the transfer of data between the offboard server and a client processor of FIG. 2.

The flow chart shown in FIG. 3 illustrates an exemplary method for expediting the transfer of data between the offboard server and a client processor, and will be described in detail in the following section.

INDUSTRIAL APPLICABILITY

The disclosed system and method for expediting data transfer between the locomotives in a consist and an offboard server can be applicable to any locomotive consist that includes a communication system. Client processors on each locomotive are able to determine the size of files that are to be transferred between the client processors and the offboard server. A client processor on any one of the locomotives can then establish parallel communication pathways between the client processor and the offboard server. The communication pathways and the relative sizes of portions of the file to be transferred over each pathway can be determined to expedite the data transfer. The use of multiple routers or other data directing devices on each of the locomotives in the consist, and multiple communication management units may also provide redundancy of data transfer when desired. The data to be transferred between a client processor and the offboard server may be divided up into subsets of data packets to be transferred over the parallel communication pathways. Duplicate subsets of some or all of these subsets of data packets may be transferred along separate parallel pathways to ensure the integrity of the total file or message being transferred.

FIG. 3 is a flowchart illustrating an exemplary disclosed method for establishing parallel communication pathways for transferring data between a client processor on a locomotive and an offboard server using the components illustrated in FIG. 2. The method begins with a client processor on a first locomotive of a consist sending route requests to an associated router on the first locomotive. The route requests are to establish parallel communication pathways between the client processor and an offboard server (step 302).

The associated router on the first locomotive communicates with one or more additional routers or other data directing devices located on other locomotives of the consist to establish the parallel communication pathways (step 304). In one exemplary implementation, the client processor on a lead locomotive may determine that a data file should be divided up into thirds and transferred over three parallel communication pathways through routers and communication management units on three different locomotives. The client processor may communicate over a LAN on the lead locomotive with an IC router on the lead locomotive. The IC router on the lead locomotive may then communicate over intra-consist electrical cable 80 with IC routers on two trailing locomotives to establish sets of NAT rules that will govern the direction of traffic. In various exemplary implementations, the IC router on the lead locomotive may provide proxy IP addresses to the client processor that the client processor will use in order to send data traffic to the offboard server via the communication management units on each of the trailing locomotives.

The client processor on the lead locomotive may also request file size information from the offboard server via its associated IC router (step 306). In various alternative implementations, the offboard server may provide information to the client processor, such as requesting that a file be uploaded from the client processor to the offboard server.

The client processor may determine how to divide up a file to be requested for download from the offboard server for transfer over the established parallel communication pathways (308). Alternatively, the client processor may determine how to divide up a file that the offboard server has requested to be uploaded to the offboard server from the client processor. The way in which a file is divided up may be a function of the relative available wireless speeds and/or bandwidths for each of the parallel communication pathways.

The client processor may initiate file transfer over the established parallel communication pathways (step 310). In the exemplary implementation discussed above, the client processor on the lead locomotive may initiate three simultaneous file transfers of a third of the data each. A first download request may be sent to the offboard server requesting the first third of the file. This first request may be sent to the offboard server via the communication management unit on the lead locomotive. A second download request may be sent to the offboard server requesting the second third of the file. This second request may be sent via the communication management unit on a trailing locomotive. The third simultaneous download request may be sent to the offboard server requesting the final third of the file. This third request may be sent via the communication management unit on another trailing locomotive.

At step 312, the portions of the file transferred over the parallel communication pathways may be recombined at either the client processor (when the file is downloaded from the offboard server) or at the offboard server (when the file is uploaded to the offboard server from the client processor). In alternative implementations where duplicative subsets of data packets are transferred in order to provide redundancy, the duplicative subsets of data may be discarded before the subsets of data packets are recombined.

It will be apparent to those skilled in the art that various modifications and variations can be made to the disclosed system and method for expediting data transfer for a locomotive. Other embodiments will be apparent to those skilled in the art from consideration of the specification and practice of the disclosed system and method. It is intended that the specification and examples be considered as exemplary only, with a true scope being indicated by the following claims and their equivalents.

What is claimed is:

1. A system for expediting the transfer of data between an offboard server and a locomotive in a consist, comprising:

a wireless device located on each of a plurality of locomotives in the consist;

a router located on each of the locomotives in the consist, each router being communicatively coupled to an associated wireless device; and a client processor located onboard each of the locomotives in the consist, each client processor being configured to:

divide data to be transferred between the offboard server and the client processor into a plurality of subsets of data packets; and request transfer of each of the plurality of subsets of data packets in parallel between the offboard server and a different one of the routers on a different one of the plurality of locomotives.

2. The system of claim 1, wherein the client processor is configured to request download of the data from the offboard server via each of the routers on different ones of the plurality of locomotives.

3. The system of claim 1, wherein the client processor is configured to request upload of the data from the client processor via each of the routers on different ones of the plurality of locomotives to the offboard server.

4. The system of claim 2, wherein the client processor is further configured to combine the plurality of subsets of data packets received by each of the routers.

5. The system of claim 3, wherein the offboard server is configured to combine the plurality of subsets of data packets received from the routers.

6. The system of claim 1, wherein the client processor is further configured to:

send a route request to a router onboard the same locomotive as the client processor, the route request causing the router to communicate with at least one other router onboard a different locomotive in the consist;

establish a set of network address translation rules that define parallel communication pathways between the offboard server and each of the communicating routers; and assign a proxy IP address for each of the parallel communication pathways that the client processor will use to transfer data between the client processor and the offboard server.

7. The system of claim 1, wherein each of the wireless devices is a communication management unit that provides a default gateway for establishing a wireless connection between the router communicatively coupled to the wireless device and the offboard server.

8. The system of claim 1, wherein data is transferred between the offboard server and the client processor using a data transfer protocol selected from one of Hypertext Transfer Protocol (HTTP), File Transfer Protocol (FTP), or Secure Copy Protocol (SCP).

9. The system of claim 1, wherein each router is communicatively coupled to an associated wireless device over a Local Area Network (LAN).

10. A method of expediting the transfer of data between an offboard server and a client processor onboard a locomotive in a consist, the method comprising:

sending a route request from the client processor to an associated router on the locomotive, the route request including a request to establish multiple parallel communication pathways between the client processor and the offboard server;

establishing communication between the associated router and one or more additional routers on other locomotives of the consist to establish the multiple parallel communication pathways;

determining an amount of data to be transferred between the client processor and the offboard server;

determining how to divide up the data for transfer over the multiple parallel communication pathways; and initiating simultaneous transfer of portions of the data over each of the multiple parallel communication pathways.

11. The method of claim 10, further including:

recombining portions of the data transferred over the multiple parallel communication pathways at one of the client processor and the offboard server.

12. The method of claim 10, wherein the route request includes a request to download the data from the offboard server via each of the routers on different ones of the locomotives.

13. The method of claim 10, wherein the route request includes a request to upload the data from the client processor via each of the routers on different ones of the locomotives to the offboard server.

14. The method of claim 12, wherein the client processor combines the portions of data received from the offboard server by each of the routers.

15. The method of claim 13, wherein the offboard server combines the portions of data received at the offboard server from each of the routers.

16. The method of claim 10, further including:

establishing a set of network address translation rules that define each of the multiple parallel communication pathways between the offboard server and each of the communicating routers; and assigning a proxy IP address for each of the parallel communication pathways that the client processor will use to transfer data between the client processor and the offboard server.

17. The method of claim 10, further including establishing a wireless connection between each of the parallel communication pathways on each of the locomotives and the offboard server through a communication management unit that acts as a default gateway for the router of each locomotive.

18. A consist of locomotives, comprising:

a plurality of locomotives, wherein each of the locomotives includes:

a control computer with a client processor configured to transfer data between an offboard server and the client processor;

a wireless device;

a router communicatively coupled to the wireless device; and wherein the client processor is configured to:

divide data to be transferred between the offboard server and the client processor into a plurality of subsets of data packets; and request transfer of each of the plurality of subsets of data packets in parallel between the offboard server and the client processor via a different one of the routers on a different one of the plurality of locomotives.

19. The consist of claim 18, wherein the client processor is configured to request the download of the data from the offboard server via each of the routers on different ones of the plurality of locomotives.

20. The consist of claim 19, wherein the client processor is further configured to combine the plurality of subsets of data packets received via each of the routers.

* * * * *